US012797955B2

(12) United States Patent
Zelina

(10) Patent No.: US 12,797,955 B2
(45) Date of Patent: Nov. 17, 2026

(54) ATOMIZATION DEVICES FOR AN ADDITIVE APPARATUS, ADDITIVE MANUFACTURING SYSTEMS INCLUDING AN ATOMIZATION DEVICE AND METHODS OF ATOMIZING A TARGET SUBSTRATE

(71) Applicant: Battelle Energy Alliance, LLC, Idaho Falls, ID (US)

(72) Inventor: Joshua N. Zelina, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 424 days.

(21) Appl. No.: 18/493,313

(22) Filed: Oct. 24, 2023

(65) Prior Publication Data

US 2024/0139818 A1 May 2, 2024

Related U.S. Application Data

(60) Provisional application No. 63/381,471, filed on Oct. 28, 2022.

(51) Int. Cl.
*B22F 12/50* (2021.01)
*B22F 9/08* (2006.01)

(52) U.S. Cl.
CPC ..... *B22F 12/50* (2021.01); *B22F 9/082* (2013.01); *B22F 2009/0848* (2013.01)

(58) Field of Classification Search
None
See application file for complete search history.

(56) References Cited

PUBLICATIONS

Chen et al., "A Comparative Study of Ti—6Al—4V Powders for Additive Manufacturing By Gas Atomization, Plasma Rotating Electrode Process and Plasma Atomization", Powder Technology, vol. 333, (2018), 9 pages.
Habib et al., "Ultrasonic Vibration-Assisted Laser Atomization of Stainless Steel", Powder Technology, vol. 321, (2017), 5 pages.

*Primary Examiner* — Anthony M Liang
(74) *Attorney, Agent, or Firm* — TraskBritt

(57) ABSTRACT

An atomization device includes a container and an atomization system. The container is sized and configured to be located within a build chamber of an additive manufacturing apparatus. The container includes a container opening in a top thereof. The container opening is sized and configured to receive an energy source of the additive manufacturing apparatus extended through the container opening or sized and configured to permit passage of energy from the energy source through the container opening. The atomization system includes a target substrate support including a device to vibrate the target substrate positioned within the container and is configured to cooperate with the additive manufacturing apparatus and utilize the energy to atomize a target substrate within the container. An additive manufacturing system and a method for atomizing a target substrate are also disclosed.

20 Claims, 5 Drawing Sheets

ATOMIZATION DEVICES FOR AN ADDITIVE APPARATUS, ADDITIVE MANUFACTURING SYSTEMS INCLUDING AN ATOMIZATION DEVICE AND METHODS OF ATOMIZING A TARGET SUBSTRATE

CROSS-REFERENCE TO RELATED APPLICATION

This application claims the benefit under 35 U.S.C. § 119(e) of U.S. Provisional Patent Application Ser. No. 63/381,471, filed Oct. 28, 2022, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05ID14517 awarded by the United States Department of Energy. The government has certain rights in the invention.

TECHNICAL FIELD

The disclosure relates generally to atomization of materials and, more specifically, to an atomization device suitable for use in conjunction with additive manufacturing machines.

BACKGROUND

Additive manufacturing (AM) processes such as Directed-Energy Deposition (DED) and others rely on high quality powder as a feedstock, as do many other fabrication processes. However, only a limited number of powders, both in alloy composition and size range, are produced commercially for these processes. The powders are generally fabricated through conventional atomization processes, which require significant investment in a commercially available atomization system. The cost of commercially available atomization systems puts this technique for powder production out of reach for most users of AM machines, which limits the types of materials that are available for AM processes, limits manufacturing capabilities, and limits the breadth of material research that may be performed with AM machines.

The above-described background relating to atomization and additive manufacturing is merely intended to provide a contextual overview of some current issues and is not intended to be exhaustive. Other contextual information may become apparent to those of ordinary skill in the art upon review of the following description of exemplary embodiments.

SUMMARY

According to some embodiments of the disclosure, an atomization device may include a container that is sized and configured to be located within a build chamber of an additive manufacturing apparatus. The container may include a container opening in a top thereof. The container opening may be sized and configured to receive an energy source of the additive manufacturing apparatus that extends through the container opening. In the alternative, the container opening may be sized and configured to permit passage of energy from the energy source through the container opening. The atomization device may further comprise an atomization system comprising a target substrate support including a device to vibrate the target substrate positioned within the container. The atomization system may be configured to interface with the additive manufacturing apparatus and utilize the energy source to atomize a target substrate within the container.

According to other embodiments of the disclosure, an additive manufacturing system may include an additive manufacturing apparatus that has a build chamber and an energy system. The energy system may include an energy source configured to generate energy. The additive manufacturing system may further include an atomization device in the build chamber. The atomization device may include a container configured to be secured within the build chamber. The container may include a container opening in a top thereof. The container opening may be sized and configured to receive the energy source to permit passage of the energy generated by the energy source through the container opening. The atomization device may further comprise an atomization system positioned within the container. The atomization system may include a target substrate support for supporting and vibrating a target substrate. The atomization system may be configured to interface with the additive manufacturing system to atomize the target substrate within the container.

According to other embodiments of the disclosure, a method for atomizing a target substrate using an atomization device in combination with an additive manufacturing apparatus may be provided. The method may include inserting an atomization device into a build chamber of an additive manufacturing apparatus. The additive manufacturing apparatus may comprise an energy source. The method may further include positioning a target substrate within a container of the atomization device, applying energy to the target substrate from the energy source to form molten material, and atomizing the molten material to form particles from the molten material.

BRIEF DESCRIPTION OF THE DRAWINGS

The disclosure is illustrated and described herein with reference to the various drawings, in which like reference numbers are used to denote like system components/method steps, as appropriate, and in which.

DETAILED DESCRIPTION

In various embodiments, the disclosure relates to atomization of material of a target substrate utilizing an atomization device according to embodiments of the disclosure inserted within a build chamber of an additive manufacturing system. The atomization device is configured to leverage existing features of conventional additive manufacturing systems to atomize the material of the target substrate to form particulate (e.g., powder) feedstock for use in an additive manufacturing process. Using such a modification of a conventional additive manufacturing system, researchers and manufacturers may create custom powder feedstock from material that is not commercially available using the same equipment that the powder feedstock will be used, while minimizing capital investment and infrastructure needed to implement atomization at a facility. For example, while some conventional alloys are available relatively cheaply from commercially available sources, such alloys are configured as solid ingots. Embodiments of the atomization device may allow such a commercially available ingot to be readily formed into usable powder for feedstock in an additive manufacturing system.

Figure 1:
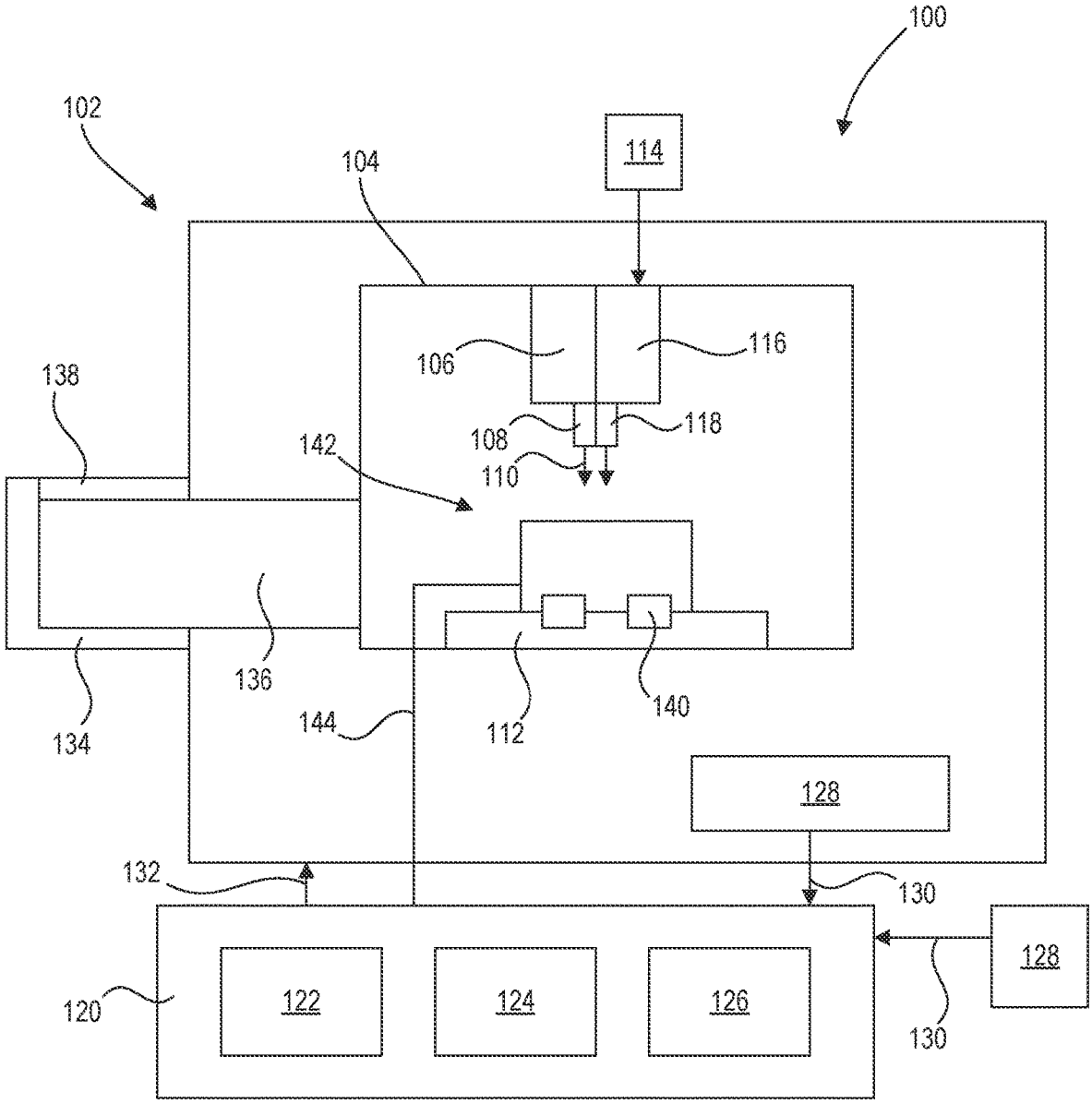
FIG. 1 is a schematic illustration of an additive manufacturing apparatus with an atomization device in accordance with embodiments of the disclosure.

FIG. 1 is a block diagram of an additive manufacturing system 100 with an atomization device 142 in accordance with embodiments of the disclosure. In some examples, the atomization device 142 may be installed on a conventional additive manufacturing system 100 as a modular attachment to the additive manufacturing system 100. In other examples, the additive manufacturing system 100 may be fabricated with the atomization device 142 integrally incorporated therein. The additive manufacturing system 100 may include an additive manufacturing apparatus 102 and machine controller 120 operably coupled to the additive manufacturing apparatus 102. In some embodiments, the additive manufacturing apparatus 102 may be a DED AM machine. The additive manufacturing apparatus 102 may be configured to receive a feedstock material 114 and manufacture an object or objects using the feedstock material 114.

In some embodiments, the additive manufacturing apparatus 102 may include a build chamber 104, a platform 112, a material feed 116, a material delivery system 118, and an energy system 106. The platform 112 may be positioned within the build chamber 104 and may be configured to be raised and lowered responsive to commands received by the additive manufacturing apparatus 102 from the machine controller 120. The platform 112 may be configured to support one or more objects being manufactured by the additive manufacturing apparatus 102 using any suitable additive manufacturing method such as directed energy deposition.

The material feed 116 may be configured to receive the feedstock material 114 to be used in the additive manufacturing of the one or more objects. In some embodiments, the material feed 116 may be configured to provide the feedstock material 114 to the material delivery system 118, which in turn may be configured to deliver the feedstock material 114 to the platform 112 in the build chamber 104. In some embodiments, the material delivery system 118 may be configured to receive and provide a powdered feedstock material 114.

The energy system 106 may include an energy source 108 to generate and focus energy 110, such as a laser, an arc, or an electron beam, on the feedstock material 114 to melt the feedstock material 114 and to form the one or more objects. The energy system 106 may be any type of energy system suitable for additive manufacturing processes, such as DED. For example, the energy system 106 may include but is not limited to a laser system, an arc system, or an electron beam system. The energy source 108 may be any type of focused energy source, such as a laser head, an arc generator, or an electron beam generator. In the embodiment illustrated in FIGS. 1 and 2, the energy system 106 may be a laser and the energy source 108 may be a laser head. The additive manufacturing apparatus 102 may be configured to manufacture the one or more objects on the platform 112, layer by layer, as the feedstock material 114 is fed to the material feed 116, delivered to the platform 112 by the material delivery system 118, and heated (e.g., melted) by the energy 110. In some examples, the material delivery system 118 and the energy source 108 may be incorporated or integrated into a single print head of the additive manufacturing system 100.

In some embodiments, the additive manufacturing apparatus 102 may also include a glovebox 134. The glovebox 134 may be a laser-safe box and may be configured for use with, and to contain, volatile materials. In some embodiments, the glovebox 134 may include a glovebox port 136 that connects to the build chamber 104 and a port access 138. The port access 138 may provide access to the glovebox 134. The glovebox port 136 may connect the glovebox 134 to the build chamber 104. The glovebox 134 may be configured for providing access to the build chamber 104 and for removal of the one or more objects from the platform 112. In some embodiments, the glovebox 134 may provide access to the build chamber 104 while maintaining an atmospheric seal at the build chamber 104.

In some embodiments, the additive manufacturing system 100 may further include sensors 128 (e.g., internal to the additive manufacturing apparatus 102 and/or external to the additive manufacturing apparatus 102). In some of these embodiments, the sensors 128 may be configured to monitor various aspects of the manufacturing process, such as conditions of the additive manufacturing apparatus 102, various input factors, and manufacturing outcomes, such as detecting manufacturing progress, faults in manufacturing, and the like. The sensors 128 may be configured to generate sensor signals 130 and provide the sensor signals 130 to the machine controller 120.

The machine controller 120 may be configured to control at least a portion of operation of the additive manufacturing apparatus 102. The machine controller 120 may be configured to control the additive manufacturing apparatus 102 using control signals 132 including commands (e.g., one or more programs) configured to indicate to the additive manufacturing apparatus 102 specific parameters of operation. By way of non-limiting examples, the machine controller 120 may be configured to control feeding of the feedstock material 114 into the material feed 116, operation of the material delivery system 118, operation of the energy system 106, operation of the sensors 128, other operations, or combinations thereof.

In some embodiments, the machine controller 120 may include a processor 122, memory 124, and one or more storage devices 126. The memory 124 may store computer-executable instructions that, when executed, cause the processor 122 to control the additive manufacturing apparatus 102 including the various components of the additive manufacturing apparatus 102. The storage device 126 may be configured to store manufacturing instructions, input factors for the AM process, data obtained from the sensor signals 130, and the like.

The atomization device 142 may be sized and configured to be positioned within the build chamber 104, such as on or above the platform 112 and may be configured to utilize the energy 110 of the additive manufacturing apparatus 102 to atomize a substrate. In some embodiments, the atomization device 142 may be secured within the build chamber 104 via a mounting device 140 such as a receiver within the platform 112 operable to hold and secure the atomization device 142, one or more clamps operable to secure the atomization device 142 to the platform 112, or the like. The mounting device 140 may be compatible with a universal mounting system of the additive manufacturing apparatus 102. In some embodiments, the mounting device 140 may be configured to align the atomization device 142 relative to the energy system 106 so that the energy system 106 may focus energy on a substrate. In the embodiment illustrated, the atomization device 142 may be mounted (e.g., clamped) to the platform 112. In some embodiments, the atomization device 142 may include a connector 144 such as in the form of a wiring harness that facilitates communication between the atomization device 142 and the machine controller 120.

Figure 2:
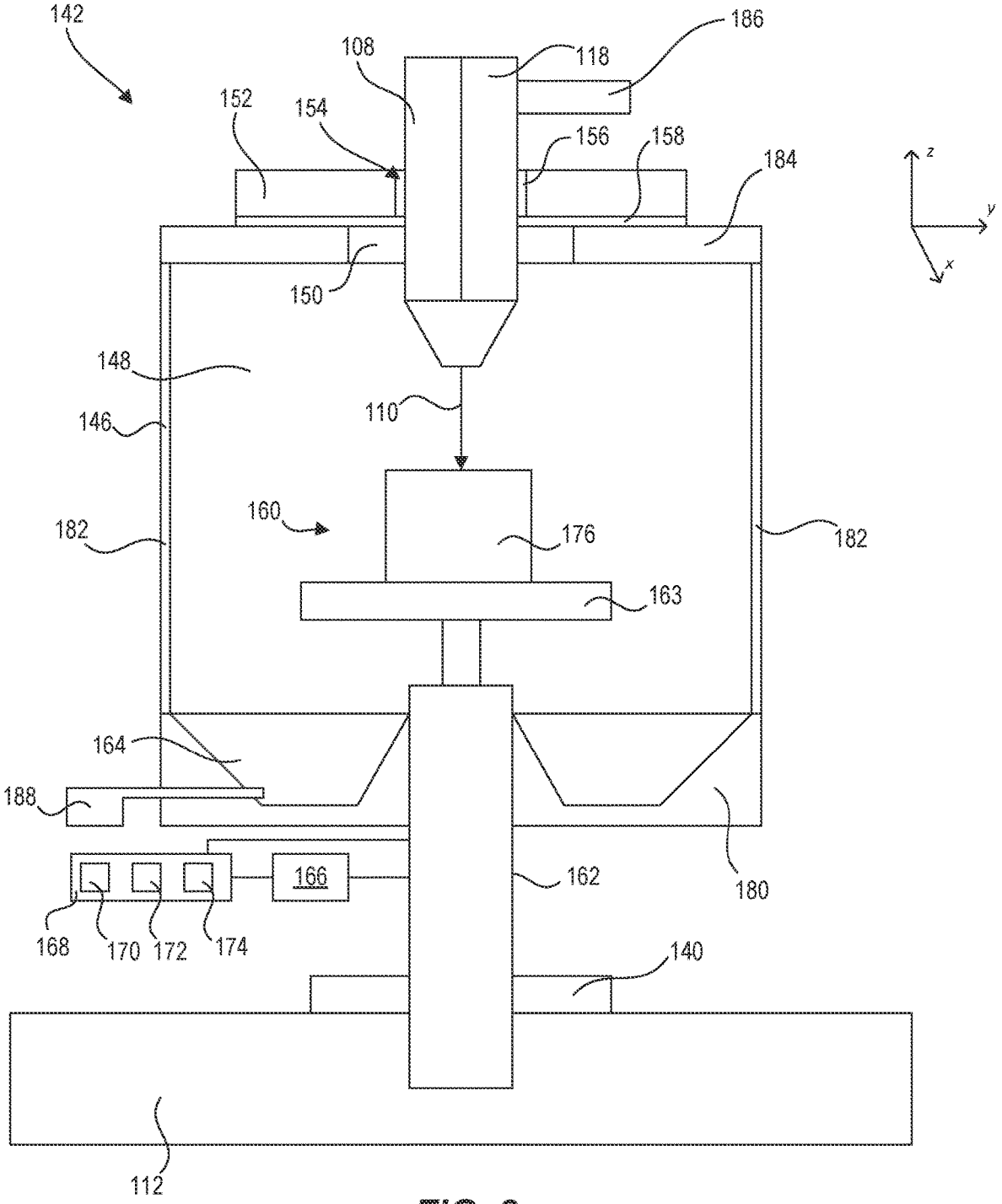
FIG. 2 is a schematic illustration of an embodiment of the atomization device of FIG. 1 in accordance with the disclosure.

FIG. 2 is a block diagram of an embodiment of the atomization device 142 of FIG. 1 in accordance with embodiments of the disclosure. Referring to FIG. 2, the atomization device 142 may include a container 146, an atomization system 160, and a catch system 164. The container 146 may be configured to be secured within the build chamber 104 of the additive manufacturing system 100 (see FIG. 1). Surfaces of the container 146 may define an atomization chamber 148 and may support the various components of the atomization device 142. The container 146 may include a bottom 180, walls 182, and a top 184 and may define an enclosure that may operate as a powder catch device to contain atomized powder from the atomization process.

In some embodiments, the container 146 may be formed of a metal. The container 146 may be configured to contain atomized droplets, powder, and any splatter of molten material within the atomization chamber 148 for collection of the powder material and to prevent contamination or damage to the additive manufacturing apparatus 102. The container 146 may include a container opening 150 formed in the top 184. In one example, the container opening 150 may be configured such that the energy source 108 may extend therethrough. In another example, the container opening 150 may be configured such that the energy 110 generated from the energy source 108 passes through the container opening 150, such as by directing the energy 110 through the container opening 150. In some embodiments, the container 146 may be configured to be disassembled into multiple pieces that are each sized to fit through the glovebox port 136 for reassembly (refer to FIG. 1).

In some embodiments, the atomization device 142 may include a container lid 152 that is configured to be positioned adjacent to the container opening 150, such as to cover the container opening 150. The container lid 152 may be sized and configured to be positioned in any combination of over, under, and partially within the container opening 150. In some embodiments, the container lid 152 may be formed of a transparent thermoplastic material, such as polymethyl methacrylate (plexiglass). The container lid 152 may be structured to interface with the container 146 to contain the atomized droplets, powder, and any splatter of molten material within the atomization chamber 148 for collection of the powder material and to prevent contamination or damage to the additive manufacturing apparatus 102. The container lid 152 may define a lid opening 154 that is configured to receive the energy source 108 and/or is configured to allow the energy 110 to pass therethrough. In some embodiments, the atomization device 142 may also include a seal 156 positioned within the lid opening 154 and that is configured to form a seal, such as an airtight seal, between the container lid 152 and the energy source 108. In some examples, the seal may be omitted such that there is no airtight seal between the lid opening 154 and the energy source 108.

In some embodiments, the atomization chamber 148 may be filled with an inert gas that facilitates the atomization process. For example, an inert gas source 186 may be connected with the energy source 108 and/or the material delivery system 118, which may be a print head of the additive manufacturing system 100 (see FIG. 1). The inert gas source 186 may thus be in fluid communication with the atomization chamber 148 and may provide a continual flow of inert gas into the atomization chamber 148 to maintain an inert gas environment within the atomization chamber 148 during the atomization process. In some examples, the inert gas source 186 may provide argon to the atomization chamber 148. In some examples, the inert gas source 186 may provide a combination of nitrogen and argon or a combination of helium and argon. These examples are not intended to be limiting and any suitable gas environment may be provided to the atomization chamber 148 via the inert gas source 186. By providing and maintaining the inert gas environment within the atomization chamber 148, the inert gas does not have to be provided within all of the build chamber 104 (see FIG. 1), although this is not intended to be limiting, and, in some examples, the inert gas environment may also be maintained within the additive manufacturing apparatus 102.

In some embodiments, at least a portion of the container lid 152 is configured to move with the energy source 108 during an atomization process. In some embodiments, the atomization device 142 may include a lid seal 158 to form a seal, such as an airtight seal, between the top 184 of the container 146 and at least the portion of the container lid 152 with the lid seal 158 maintaining a seal during relative movement between the container lid 152 and the top 184 of the container 146. In some embodiments, the container opening 150 may be sized and configured to accommodate a relative movement of the energy source 108 and the container 146 laterally and longitudinally (i.e., in the X-Y plane) and vertically (i.e., Z direction), such as a full range of motion of the energy source 108.

In some embodiments, the top 184 may be configured to move with the energy source 108 and the container lid 152 during the atomization process. In some embodiments, the energy source 108 may be configured to move vertically (i.e., in the Z direction) relative to the container lid 152 and the top 184 of the container 146. The walls 182 on the side of the container 146 may comprise a flexible thin film that may accommodate the vertical movement of the top 184 and the container lid 152. For example, the walls 182 may compress to allow the energy source 108 and the top 184 of the container 146 to travel downwards (the negative Z direction shown in FIG. 2), and the walls 182 may return to an initial height to allow the energy source 108 and the top 184 of the container 146 to return upwards (the positive Z direction shown in FIG. 2).

The atomization system 160 may be positioned within the container 146 and may be configured to interface with the additive manufacturing system 100 to atomize material of a target substrate 176 within the build chamber 104. In some embodiments, the cooperation may include utilizing the energy 110 to atomize the material of the target substrate 176, such as by coordinating movements and functions of the atomization system 160 with movements and functions of the additive manufacturing system 100 including but not limited to the energy source 108. For example, additive manufacturing system 100 may be utilized to move the energy source 108 vertically (i.e., in the Z direction) relative to the target substrate 176 to provide energy 110 to the target substrate 176. The additive manufacturing system 100 may also be configured to move the platform 112 laterally and longitudinally (i.e., in the X-Y plane) relative to the energy source 108 to provide energy 110 across the target substrate 176. Other movement controls may also be provided such as to move the platform 112 in the Z direction or to move the energy source 108 in the X-Y plane.

The atomization system 160 may include one or more components for facilitating the target substrate material atomization process. As shown in FIG. 2, the atomization system 160 may be configured as an ultrasonic laser atomizer (utilizing a laser head of the additive manufacturing system 100 as discussed above) and may include an ultrasonic probe 162 that supports and is configured to vibrate the target substrate 176. In some examples, the atomization system 160 may comprise a platform 163 supported by the ultrasonic probe 162 to which the target substrate is attached. The platform 163 may be operable to transmit vibrations from the ultrasonic probe 162 to the target substrate 176. In this example, the platform 163 and ultrasonic probe 162 may together be termed a target substrate support. In other embodiments, the atomization system 160 may be configured as a rotating electrode press atomizer that includes a motor and electrodes (not shown). In some embodiments, the atomization chamber 148 may be configured with an evacuation structure 188 to form at least a partial vacuum and to receive a gas, such as a combination of helium and argon.

A catch system 164 may be configured to collect (e.g., catch) the atomized droplets/powder resulting from the atomization process. The catch system 164 may comprise any of a bagging system, a catch pan, a hopper, a trough, and the like for collecting the powder material. In the example shown in FIG. 2, the catch system 164 may include a trough formed into the bottom 180 of the container 146. The trough may have sloped sides that facilitate collection of the powder material via gravity. The collected powder may be removed from the catch system 164 via the evacuation structure 188 and tested, recirculated to the feedstock material 114, stored for future use, or the like.

In some embodiments, the atomization system 160 may include an integral power source 166. In other embodiments, the atomization system 160 may be configured to connect to the additive manufacturing apparatus 102 to obtain power. In further embodiments, the atomization system 160 may be configured to connect to an independent power source.

In some embodiments, the atomization system 160 may connect to the machine controller 120 and may be configured to be controlled by the machine controller 120. In other embodiments, such as the embodiment illustrated in FIG. 2, the atomization device 142 may include a device controller 168 that is configured to control the atomization system 160 and coordinate operation of the atomization system 160 with operation of the additive manufacturing apparatus 102 via the machine controller 120. For example, the device controller 168 may be operable to receive control instructions from the machine controller 120 regarding operation of the additive manufacturing apparatus 102. The device controller 168 may further be operable to send control instructions to the machine controller 120 of the additive manufacturing apparatus 102 to control one or aspects of the additive manufacturing apparatus 102.

In some embodiments, the device controller 168 may include a processor 170, memory 172, and one or more storage devices 174. The memory 172 may store computer-executable instructions that, when executed, cause the processor 170 to control the atomization system 160 in any manner disclosed herein or to perform any relevant method as disclosed herein. The storage device 174 may be configured to store atomization instructions, control instructions for the atomization system 160 and/or the additive manufacturing apparatus 102, and the like.

Figure 3:
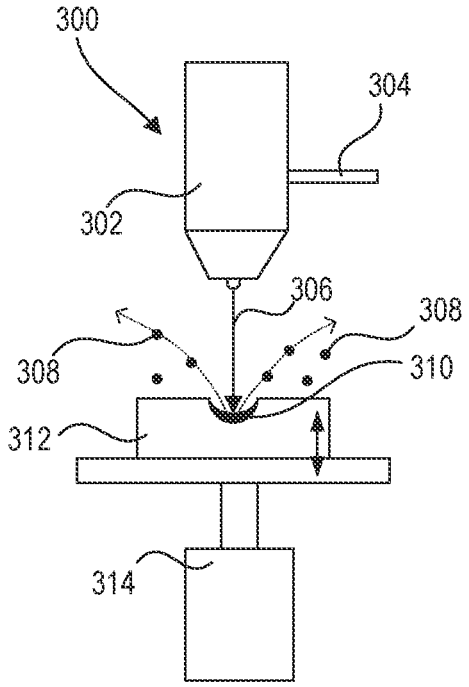
FIG. 3 is a schematic illustration of an ultrasonic atomization system.

FIG. 3 is a schematic illustration of an ultrasonic laser atomization system 300. The laser atomization system 300 may be an example of a system utilized in the atomization device 142 discussed above. In the embodiment illustrated in FIG. 3, the laser atomization system 300 may comprise a laser system 302 as an energy source. The laser atomization system 300 may further comprise an ultrasonic probe 314 operable to vibrate a target substrate 312. While the target substrate 312 is vibrating, the laser system 302 may direct a laser 306 at the target substrate 312, which melts a portion of the target substrate 312 into a molten material 310. The vibration of the target substrate 312 may cause atomized droplets 308 to form and disperse. The atomized droplets 308 may be collected in the catch system 164 (see FIG. 2). An inert gas 304, such as helium or argon gas, may be supplied and used for environmental passivation for droplet formation during the ultrasonic laser atomization process. In some examples, more than one ultrasonic probe 314 may be provided to ensure sufficient propagation of the vibrations through the target substrate 312.

Figure 4:
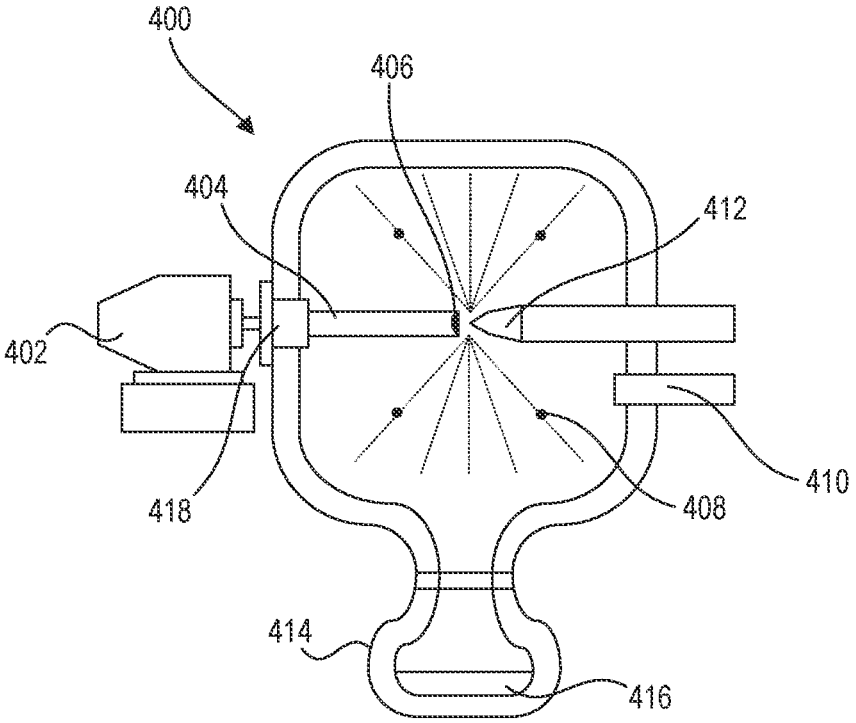
FIG. 4 is a schematic illustration of a rotating electrode press atomization system.

FIG. 4 is a schematic illustration of a rotating electrode press atomization system 400. The rotating electrode press atomization system 400 may be another example of a system utilized in the atomization device 142 discussed above. The rotating electrode press atomization system 400 may comprise a motor 402. In some examples, the motor 402 may be substituted for the laser head of an additive manufacturing apparatus, such as the additive manufacturing apparatus 102 discussed above. The motor 402 may rotate a target substrate 404 fixed thereto within a container, such as container 146 shown in FIG. 2. The rotating electrode press atomization system 400 may comprise a negatively charged fixed electrode 412 that works in tandem with a positively charged fixture 418 attached to and rotated by the motor 402. The electrode 412 and fixture 418 may be used to form a plasma that may be utilized to form molten material 406 from a target substrate 404. The rotation of the target substrate 404 may be operable to atomize the molten material 406 centrifugally. The atomized droplets 408 may be collected in a catch system 414. An inert gas 410, such as helium or argon gas, may be supplied and used for environmental passivation for droplet formation in the rotating electrode press atomization system 400.

In the example shown in FIG. 4, the target substrate 404 is rotated about a horizontal axis. However, this is not intended to be limiting. In some embodiments, the target substrate 404 may be rotated around a vertical axis in alignment with the fixed electrode 412, and the atomized droplets 416 may be received in an annular trough comprising catch system 414 at the bottom of the container. The specific configuration shown in FIG. 4 is not intended to be limiting. For example, while the rotating electrode press atomization system 400 shown in FIG. 4 utilizes the negatively charged electrode 412 to form the molten material 406, the system 400 may also utilize a laser system such as the laser system 302 shown in FIG. 3, to form the molten material 406.

Figure 5:
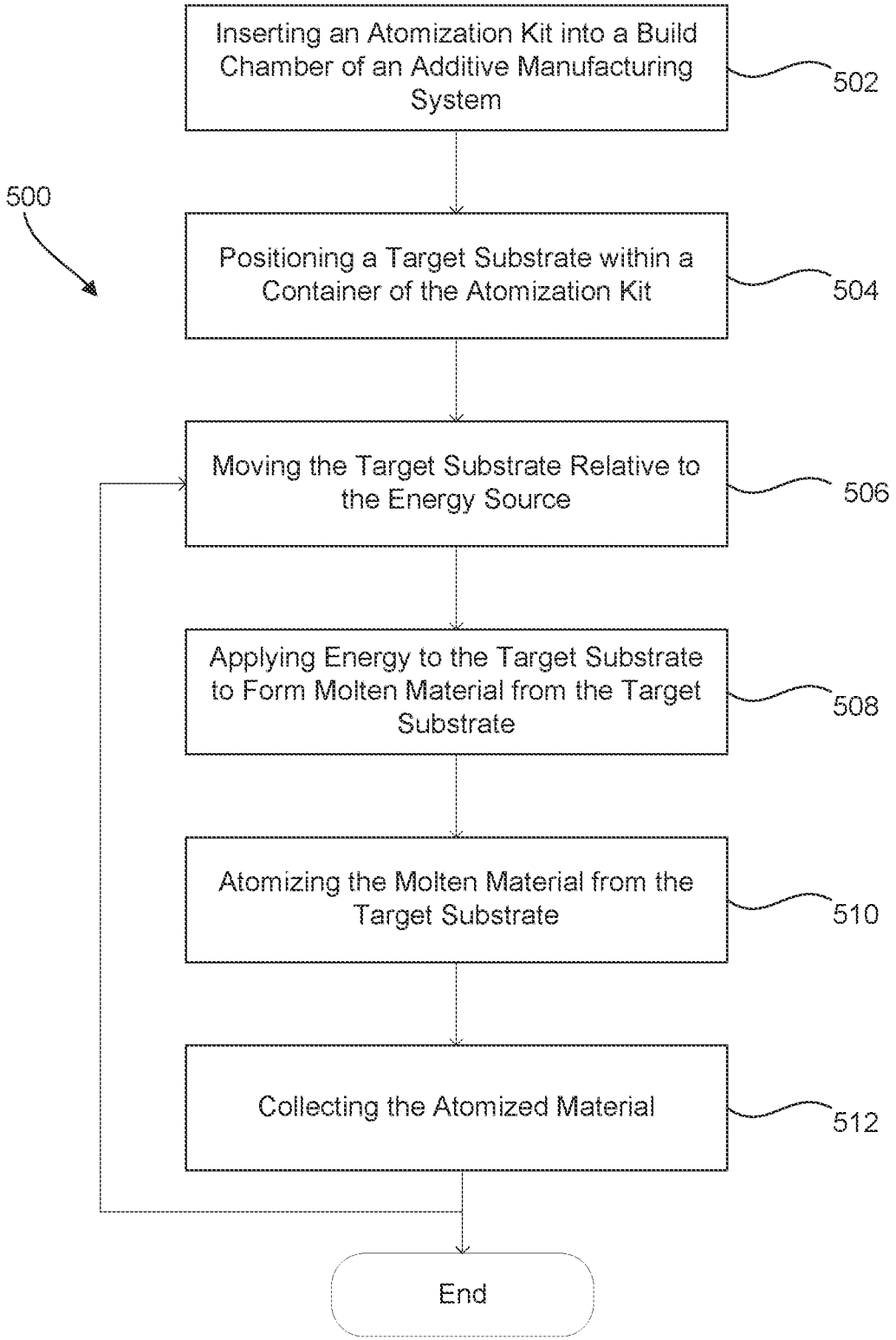
FIG. 5 is a flowchart of a method for atomizing a substrate using an atomization device in accordance with embodiments of the disclosure.

FIG. 5 is a flowchart of a method 500 for atomizing a substrate using an atomization device in accordance with embodiments of the disclosure. The method 500 may include inserting an atomization device into a build chamber of an additive manufacturing apparatus in act 502. The atomization device may be any embodiment of the atomization device disclosed herein. In some embodiments, act 502 may include aligning the atomization device relative to an energy system of the additive manufacturing apparatus. In some embodiments, act 502 may include clamping or otherwise securing the atomization device within the build chamber, such as by clamping the atomization device to the platform using clamps. In some embodiments, act 502 may include inserting components of the atomization device into the build chamber via a glovebox port and assembling the atomization device within the build chamber. In some embodiments, act 502 may include positioning and securing an already-assembled atomization device in the build chamber.

The method 500 may also include positioning a target substrate within a container of the build chamber in act 504. For example, a target substrate may be placed within the container such that the target substrate may be on an ultrasonic probe or may be mounted to a motor to be rotated by the motor.

The method 500 may further include moving the target substrate relative to the energy source in act 506. For example, movement of the target substrate relative to the energy source may be achieved by coordinating movements and functions of the atomization device with movements of the energy source to align the energy source with a desired portion of the target substrate. In some embodiments, act 506 may include utilizing the additive manufacturing apparatus to move a platform on which the atomization device is mounted and/or moving the energy source relative to the atomization device to align the energy source with the target substrate or with a desired portion of the target substrate.

The method 500 may further comprise applying energy to the target substrate to form a molten material from the target substrate in act 508. For example, energy from an energy source, such as a laser, may melt the target substrate forming a melted pool of the target material on at least a portion of the target substrate. In act 510, the molten material from the target substrate is atomized. For example, an ultrasonic probe may be used to vibrate the melted material, atomizing the melted material and consuming the target substrate. The method 500 may further include collecting the atomized material of the target substrate. For example, the vibrated material may form droplets that are then cooled and collected as a powder. In one example, the powder formed by vibrating the melted pool of material may be captured in a catch system, such as a catch pan. After act 512, the method may be repeated from act 506 where the target substrate is moved to a new position relative to the energy source. When a desired amount of the target substrate is atomized, or when the target substrate is consumed, the method 500 may be completed.

Acts 506, 508, 510, 512 may be performed substantially simultaneously until a desired amount of atomized material is collected or until the target substrate is consumed. For example, the target substrate may be continually moved (act 506) while applying energy to the substrate via the energy source to form molten material (act 508). The substrate may simultaneously be vibrated to atomize the molten material (act 510), and the atomized material may be collected (act 512).

In some embodiments, act 506 of the method 500 may include creating a model of the target substrate, such as by three-dimensional (3D) scanning the target substrate, generating a 3D printer control code for the target substrate based on the model, inverting the 3D printer control code, inputting the inverted 3D printer control code into the machine controller (such as machine controller 120 shown in FIG. 1), and utilizing the inverted 3D printer control code to control the additive manufacturing apparatus (such as the energy system 106 and platform 112 of the additive manufacturing apparatus 102 of FIG. 1) to move the target substrate relative to the energy source. By inverting the 3D control code, the additive manufacturing apparatus may be configured to move in a pattern opposite to that of printing the target substrate, such as raising the platform after each layer of the target substrate is atomized (or lowering the energy source after each layer of the target substrate is atomized) rather than the platform lowering after each layer of an object being added (or raising the laser head after each layer of an object being added). By inverting the 3D control code, the atomization device may be used to atomize the target substrate within the additive manufacturing apparatus without modifying the additive manufacturing apparatus or the machine controller thereof. In some embodiments, the method 500 may also include determining a center of gravity of the target substrate to create the tool path for the laser, forming (e.g., drilling) a hole close to the center of gravity of the target substrate and clamping the target substrate to the atomization system, such as to the ultrasonic probe.

In some embodiments, the method 500 may include modifying an atmosphere within at least the atomization chamber of the atomization device, such as by filling the atomization chamber with an inert gas such as helium or argon.

By including an atomization device in the build chamber of an additive manufacturing apparatus, the atomization device may be utilized to atomize a target substrate utilizing existing components of the additive manufacturing apparatus, such as the energy system and the structure of the additive manufacturing apparatus that defines the build chamber, which may be configured to provide safety measures, such as safety measures for use with a laser energy source. The infrastructure provided by the additive manufacturing apparatus and using the atomization device according to embodiments of the disclosure may make atomization of a target material more accessible and allow researchers and manufacturers to create custom powder feedstock from material that is not commercially available. For example, while some conventional alloys are available relatively cheaply from commercially available sources, such alloys are configured as solid ingots. Embodiments of the atomization device may allow such a commercially available ingot to be readily formed into usable powder for feedstock in an additive manufacturing system.

Furthermore, by incorporating the atomization device into an additive manufacturing apparatus, users may utilize existing equipment to atomize a target material. Further, using the atomization device may reduce up-front equipment cost, installation costs and operational costs, and may reduce facility modifications needed for a facility to atomize materials and generate feedstock. The atomization device may be inserted or removed depending on acts to be conducted within the build chamber. For instance, the atomization device may be inserted into the additive manufacturing apparatus when atomization of a target substrate is desired or may be removed when a 3D printing process is desired.

In some examples, an additive manufacturing system may be constructed with the atomization device built into the additive manufacturing apparatus. In these examples, the additive manufacturing system already incorporates the atomization device and may provide atomization of a target material for researchers and manufacturers without a separate atomization system.

Figure 6:
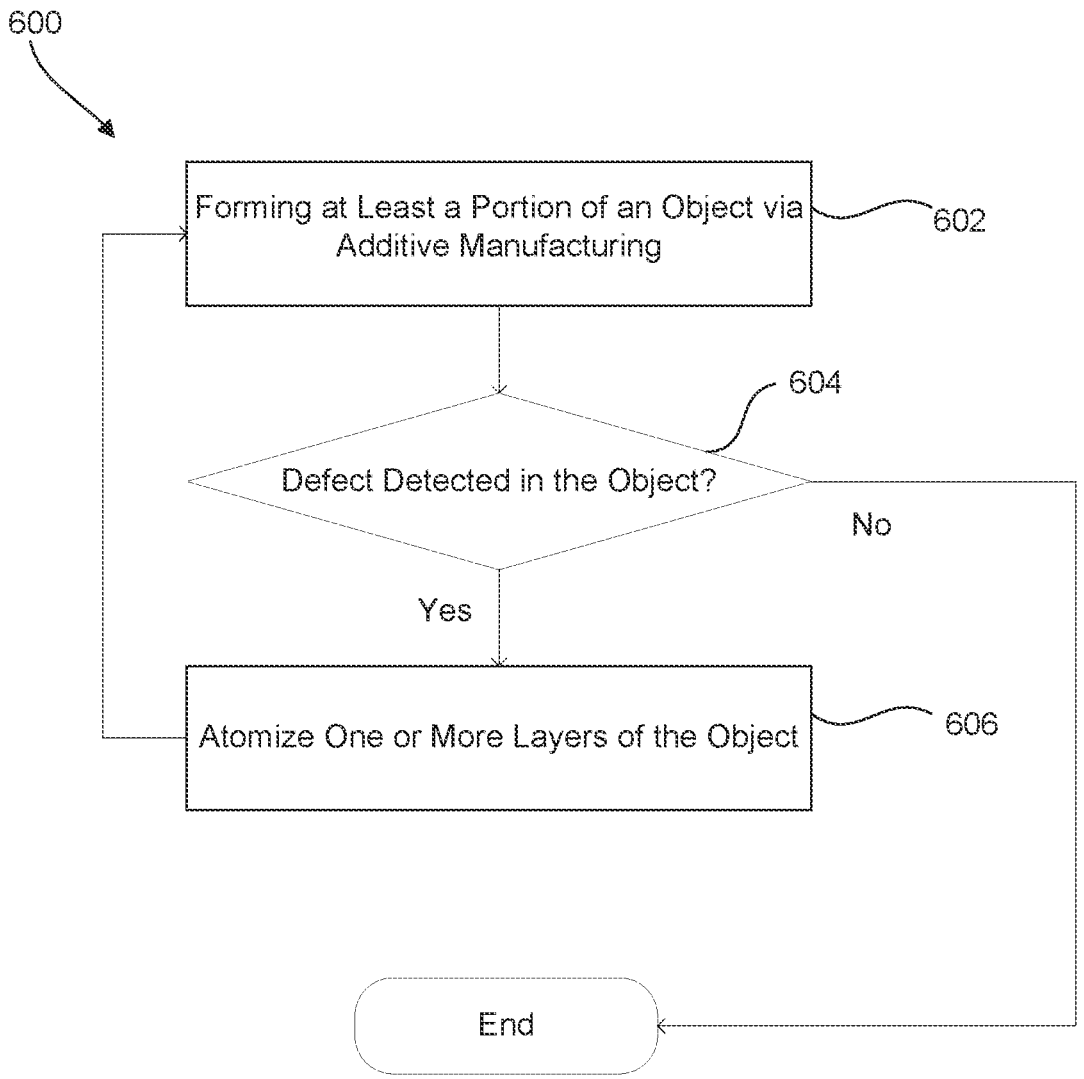
FIG. 6 is a flowchart of a method 600 for utilizing an atomization device within an additive manufacturing process in accordance with embodiments of the disclosure.

In some examples, the atomization device may provide additional functionality to an additive manufacturing apparatus. FIG. 6 is a flowchart of an exemplary method 600 for utilizing an atomization device in an additive manufacturing process. The method 600 may comprise forming at least a portion of an object via an additive manufacturing process in act 602. For example, a portion of an object may be formed via DED or other additive manufacturing processes. In act 604, a defect may be observed in the object formed via the additive manufacturing process. The defect may be present in one or more printed layers of the object formed via the additive manufacturing process. If the defect is observed, the process proceeds to act 606. If no defect is observed, the process ends. In act 606, one or more layers of the object may be atomized, removing the defect from the object. Act 606 may be conducted in a manner similar as described above, such as with reference to acts 506, 508, 510, and 512 described with reference to FIG. 5. Thus, the atomization device may provide a process to "erase" (e.g., remove) a defect detected in an object during or after an additive manufacturing process.

Other modifications to the systems and methods discussed above may be incorporated. For example, in the above-described examples, molten material is formed on the target substrate. The molten material is then atomized via vibration or centrifugally from the target substrate. However, in other examples, the molten material may be removed from the target substrate prior to atomization. For example, the target substrate may not be directly supported by the ultrasonic probe. Instead, the molten material formed of the target substrate may be caused to flow onto the ultrasonic probe at which point the molten material is atomized via the ultrasonic probe. In other examples, instead of using an ultrasonic probe, the molten material may be atomized via jets of fluid (such as a gas or water jet).

The various illustrative logical blocks, modules, and circuits described in connection with the embodiments of the atomization device, and of the atomization device in conjunction with the additive manufacturing system, disclosed herein may be implemented or performed with a general purpose processor, a special purpose processor, a digital signal processor (DSP), an Integrated Circuit (IC), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor (may also be referred to herein as a host processor or simply a host) may be a microprocessor, but in the alternative, the processor may be any conventional processor, controller, microcontroller, or state machine. A processor may also be implemented as a combination of computing devices, such as a combination of a DSP and a microprocessor, a plurality of microprocessors, one or more microprocessors in conjunction with a DSP core, or any other such configuration. A general-purpose computer including a processor is considered a special-purpose computer while the general-purpose computer is configured to execute computing instructions (e.g., software code) related to embodiments of the disclosure.

The embodiments may be described in terms of a process that is depicted as a flowchart, a flow diagram, a structure diagram, or a block diagram. Although a flowchart may describe operational acts as a sequential process, many of these acts may be performed in another sequence, in parallel, or substantially concurrently. In addition, the order of the acts may be re-arranged. A process may correspond to a method, a thread, a function, a procedure, a subroutine, a subprogram, other structure, or combinations thereof. Furthermore, the methods disclosed herein may be implemented in hardware, software, or both. If implemented in software, the functions may be stored or transmitted as one or more instructions or code on computer-readable media. Computer-readable media includes both computer storage media and communication media including any medium that facilitates transfer of a computer program from one place to another.

As used herein, the term "substantially" in reference to a given parameter, property, or condition means and includes to a degree that one of ordinary skill in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the terms "adapted," "configured," and "configuration" refers to a size, a shape, a material composition, a material distribution, orientation, and arrangement of at least one feature (e.g., one or more of at least one structure, at least one material, at least one region, at least one device) facilitating use of the at least one feature in a pre-determined way.

Although the disclosure has been illustrated and described herein with reference to various embodiments and specific examples thereof, it will be readily apparent to those of ordinary skill in the art that other embodiments and examples may perform similar functions and/or achieve like results. All such embodiments and examples are within the scope of the disclosure, are contemplated thereby, and are covered by the following claims and their legal equivalents.

What is claimed is:

1. An atomization device, comprising:

a container sized and configured to be located within a build chamber of an additive manufacturing apparatus, the container comprising a container opening in a top thereof, the container opening being sized and configured to receive an energy source of the additive manufacturing apparatus extended through the container opening or being sized and configured to permit passage of energy from the energy source through the container opening; and an atomization system comprising a target substrate support comprising a device to vibrate a target substrate positioned within the container and configured to interface with the additive manufacturing apparatus and utilize the energy source to atomize the target substrate within the container.

2. The atomization device of claim 1, wherein the device to vibrate the target substrate comprises an ultrasonic probe.

3. The atomization device of claim 2, wherein the target substrate support comprises a platform supported by the ultrasonic probe, the platform propagating vibrations from the ultrasonic probe to the target substrate.

4. The atomization device of claim 1, wherein the container comprises walls extending between the top of the container and a bottom of the container, the walls of the container being flexible.

5. The atomization device of claim 1, wherein the container comprises walls connecting the top of the container to a bottom of the container, the walls, top, and bottom of the container defining a powder catch device to contain atomized material from the target substrate.

6. The atomization device of claim 1, further comprising a catch system configured to collect atomized powder from the atomized target substrate.

7. The atomization device of claim 6, wherein the catch system is disposed in a bottom of the container.

8. The atomization device of claim 7, wherein the catch system comprises a trough in the bottom of the container.

9. An additive manufacturing system, comprising:

an additive manufacturing apparatus comprising a build chamber and an energy system, the energy system comprising an energy source configured to generate energy; and an atomization device in the build chamber, the atomization device comprising:

a container configured to be secured within the build chamber, the container comprising a container opening in a top thereof, the container opening being sized and configured to receive the energy source to permit passage of the energy generated by the energy source through the container opening, and an atomization system positioned within the container and comprising a target substrate support for supporting and vibrating a target substrate and configured to interface with the additive manufacturing apparatus to atomize the target substrate within the container.

10. The atomization system of claim 9, wherein the atomization device is removably secured to a platform of the additive manufacturing apparatus.

11. The atomization system of claim 10, wherein the atomization device is configured to move relative to the energy source via the platform of the additive manufacturing apparatus.

12. The atomization system of claim 9, further comprising an inert gas source in fluid communication with the container and operable to provide inert gas to the container.

13. The atomization system of claim 9, wherein the additive manufacturing apparatus further comprises a glovebox providing access to the build chamber, the atomization device being configured to be inserted into the build chamber via the glovebox.

14. A method for atomizing a target substrate using an atomization device in combination with an additive manufacturing apparatus, the method comprising:

inserting the atomization device into a build chamber of the additive manufacturing apparatus, the additive manufacturing apparatus comprising an energy system comprising an energy source configured to generate energy;

positioning the target substrate within a container of the atomization device, the container configured to be secured within the build chamber, the container comprising a container opening in a top thereof the container opening being sized and configured to receive the energy source to permit passage of the energy generated by the energy source through the container opening;

applying energy to the target substrate from the energy source to form molten material; and atomizing the molten material to form particles from the molten material via an atomization system of the atomization device, the atomization system positioned within the container and comprising a target substrate support for supporting and vibrating the target substrate and configured to interface with the additive manufacturing apparatus and utilize the energy source to atomize the target substrate within the container.

15. The method of claim 14, further comprising moving the target substrate relative to the energy source.

16. The method of claim 14, further comprising collecting the particles as a powder.

17. The method of claim 14, further comprising removing the particles by vibrating the target substrate via an ultrasonic probe.

18. The method of claim 14, further comprising removing the particles by centrifugal force.

19. The method of claim 14, wherein inserting the atomization device into the build chamber of the additive manufacturing apparatus comprising inserting the atomization device into the build chamber of the additive manufacturing apparatus via a glovebox.

20. The method of claim 14, wherein positioning the target substrate within the container comprises printing the target substrate via the additive manufacturing apparatus.

* * * * *